United States Patent [19]

Hall

[11] 4,247,962

[45] Feb. 3, 1981

[54] WAVELESS WATERBED MATTRESS

[75] Inventor: Charles P. Hall, Muir Beach, Calif.

[73] Assignee: Monterey Manufacturing, Inc., Los Angeles, Calif.

[21] Appl. No.: 949,963

[22] Filed: Oct. 10, 1978

[51] Int. Cl.[2] ..... A47C 27/08

[52] U.S. Cl. ..... 5/450; 5/451

[58] Field of Search ..... 5/349, 350, 368, 369, 5/370, 371, 450, 451, 455

[56] References Cited

U.S. PATENT DOCUMENTS

| | | | |
|---|---|---|---|
| 1,371,919 | 3/1921 | Mahony | 5/455 |
| 2,604,641 | 7/1952 | Reed | 5/455 |
| 3,732,585 | 5/1973 | Krehbiel | 5/451 |
| 3,736,604 | 6/1973 | Carson, Jr. | 5/370 |
| 3,772,717 | 11/1973 | Yuen et al. | 5/450 |
| 4,145,780 | 3/1979 | Fogel | 5/370 |
| 4,152,796 | 5/1979 | Fogel | 5/451 |

*Primary Examiner*—Roy D. Frazier
*Assistant Examiner*—Alexander Grosz
*Attorney, Agent, or Firm*—Lyon & Lyon

[57] ABSTRACT

Waterbed mattress having an internal floating pad for reducing wavelike motion of the water in the mattress. The pad is fabricated of a buoyant material and is anchored to the bottom wall of the mattress, with no connection between the pad and the top wall.

12 Claims, 3 Drawing Figures

FIG-1
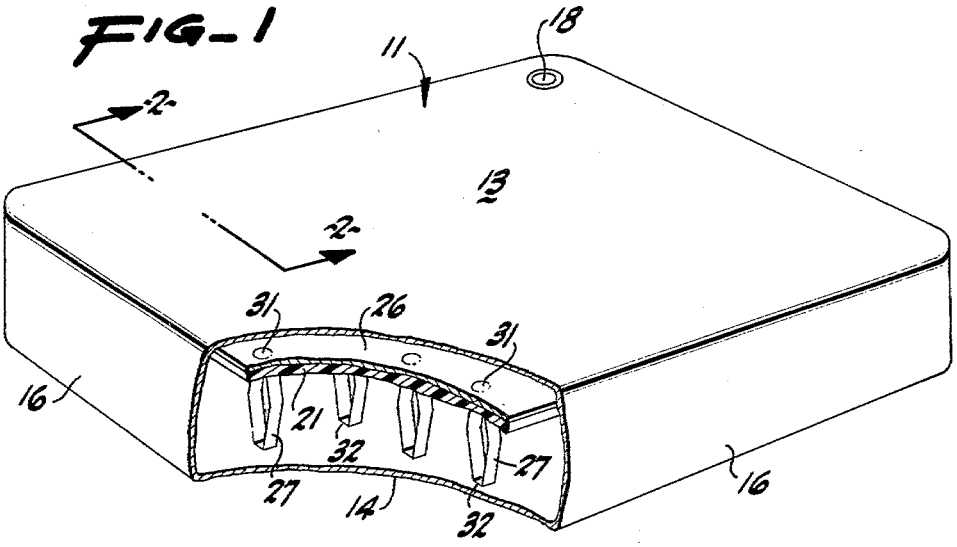
FIG-2
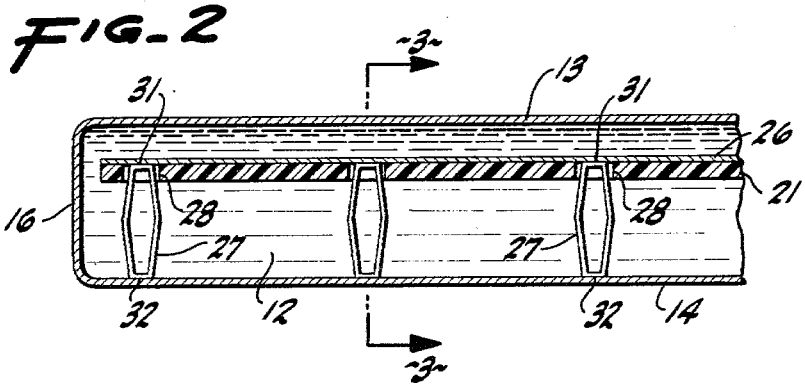
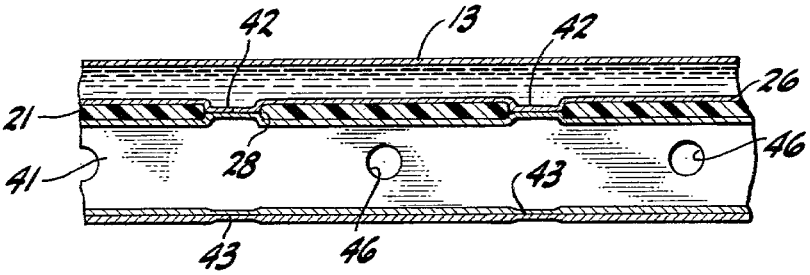
FIG-3

WAVELESS WATERBED MATTRESS

BACKGROUND OF THE INVENTION

This invention pertains generally to waterbeds and more particularly to a waterbed mattress having means for preventing excessive undulations of the water in the mattress.

Although waterbeds have enjoyed wide popularity in recent years, some persons are disturbed by the wavelike movement or undulations of the water within the mattress. There have been attempts to reduce the water movement, for example, by employing vertically extending baffles inside the mattress. However, such attempts have not been entirely satisfactory, and they generally involve connections to the top wall of the mattress and undesirable pulling or tensioning of the surface upon which the user of the mattress is resting.

SUMMARY AND OBJECTS OF THE INVENTION

The invention provides a waterbed mattress having a horizontally extending pad of buoyant material anchored to the bottom wall of the mattress. The pad floats between the top and bottom walls and serves to damp out wave motion in the water.

It is in general an object of the invention to provide a new and improved waterbed mattress having means for preventing excessive undulations of the water in the mattress.

Another object of the invention is to provide a waterbed mattress of the above character utilizing a horizontally extending pad of buoyant material anchored to float between the top and bottom walls of the mattress.

Additional objects and features of the invention will be apparent from the following description in which the preferred embodiments are set forth in detail in conjunction with accompanying drawings.

BRIEF DESCRIPTION OF THE DRAWINGS

FIG. 1 is a perspective view, partly broken away, of one embodiment of a waterbed mattress according to the invention.

FIG. 2 is a fragmentary sectional view taken along line 2—2 in FIG. 1.

FIG. 3 is is a fragmentary cross sectional view of another embodiment of a waterbed mattress according to the invention, taken in a direction corresponding to section line 3—3 in FIG. 2.

DESCRIPTION OF THE PREFERRED EMBODIMENTS

As illustrated in the drawings, the mattress comprises a generally rectangular enclosing structure 11 containing a body of water 12. The enclosing structure is fabricated of a flexible material such as vinyl and includes a top wall 13, a bottom wall 14 and side walls 16. The top wall is adapted for receiving persons in sitting and reclining positions and is at times referred to as the sleeping surface of the mattress. The enclosing structure can be formed in any suitable manner, for example, by bonding two planar sheets together along their peripheries or by bonding upstanding sheets between the edges of the top and bottom walls to form a contoured or fitted structure. Water is introduced into and removed from the mattress through a valve 18 located toward a corner of the top wall.

A horizontally extending pad of buoyant material 21 is positioned within the mattress to reduce the wavelike motion of the water. In one presently preferred embodiment, the pad is fabricated of a closed-cell polyethylene foam, although other suitable materials can be utilized, if desired. In this embodiment, the pad has a thickness on the order of ¼ inch and a horizontal extent slightly less than the sleeping area of the mattress. In a king-sized mattress measuring 84 by 72 inches, the pad can have a length of 76 inches and a width of 64 inches.

Means is provided for anchoring the pad in a floating position between the top and bottom walls of the mattress. In the embodiment of FIGS. 1–2, this means includes a flexible sheet 26 and a plurality of flexible straps 27. The flexible sheet overlies the pad, and the straps extend through openings 28 in the pad. As illustrated, the straps are formed as loops which are bonded at the top and bottom to sheet 26 and bottom wall 14, at spaced apart points, as indicated at 31,32. The straps are arranged in rows which extend lengthwise of the mattress, and a king-sized mattress can, for example, have six rows of straps, with eight straps in each row. In this embodiment, the straps are spaced about ten inches apart in either lateral direction, but other strap arrangements and spacings can be utilized, if desired. The straps and overlying sheet 26 are fabricated of a flexible material such as 20 mil vinyl, and the bonds between the straps and the overlying sheet and the bottom wall of the enclosing structure are formed by suitable means such as sonic welding. The straps can be of any suitable width, and in the embodiment of FIGS. 1–2, they are on the order of three inches wide.

The firmness of the mattress is partly dependent upon the vertical position of the buoyant pad within the enclosing structure, with the firmness increasing as the pad is positioned closer to top wall 13. With a mattress having a depth of nine inches and a ¼ inch foam pad, a good balance between firmness and wave suppression is provided by anchoring the pad to float about six inches above the bottom wall of the enclosure. The position can, of course, be selected to suit the preference of the individual user.

Openings, not shown, are provided in both the buoyant pad and the overlying sheet to assure good water circulation and heat distribution throughout the mattress and to prevent air from being trapped between the pad and sheet. The openings in the pad are preferably on the order of about ⅜ inch diameter and are spaced about one inch apart over the entire pad. The openings in the overlying sheet can, for example, be three-inch slits centered between the points of strap attachment.

In operation and use, the enclosure is filled with water, and the buoyant pad floats between the top and bottom walls at the height determined by the straps. Being anchored to the bottom wall, the pad limits the wavelike motion of the water within the mattress by damping or limiting the amplitude of the waves. Since there is no connection between the pad and the top wall, there is no undesired pulling or tensioning of the top wall as there is in mattresses having vertically extending baffles connected to the top wall.

The embodiment of FIG. 3 is generally similar to that of FIGS. 1–2 except in that it has elongated tubular members 41 in place of the individual straps. The tubular members are fabricated of a flexible material such as vinyl and are affixed at spaced apart points 42,43 to sheet 26 and bottom wall 14. Each tubular member corresponds to one row of straps, and a king-sized mattress can, for example, have six tubular members positioned side-by-side and extending lengthwise within the mattress. The tubular members are bonded to sheet 26 through openings 28 in the buoyant pad. The ends of the tubular members are open, and vent holes 46 are formed in the side walls of the members to permit water circulation. In one preferred embodiment, vent holes having a diameter on the order of three inches are spaced about ten inches apart along the tubes.

Operation and use of the embodiment of FIG. 3 is similar to that described above in connection with FIGS. 1–2.

It is apparent from the foregoing that a new and improved waveless waterbed mattress has been provided. While only certain presently preferred embodiments have been described in detail, as will be apparent to those familiar with the art, certain changes and modifications can be made without departing from the scope of the invention as defined by the following claims.

What is claimed is:

1. In a waterbed mattress: a top wall, a bottom wall, a pad of buoyant material, and means anchoring the pad to float horizontally between the top and bottom walls, the pad having a horizontal extent corresponding generally to the sleeping surface of the mattress, the pad permitting water to circulate between the volume below and the volume above the pad.

2. The waterbed mattress of claim 1 wherein the means anchoring the pad comprises a flexible sheet overlying the pad and a plurality of flexible straps passing through openings in the pad and affixed to the bottom wall and the overlying sheet.

3. The waterbed mattress of claim 1 wherein the means anchoring the pad comprises a flexible sheet overlying the pad and an elongated tubular member affixed to the bottom wall and secured to the sheet at a plurality of spaced apart points through openings in the pad.

4. The waterbed mattress of claim 3 wherein the tubular member has a plurality of vent openings in the side wall thereof.

5. The waterbed mattress of claim 1 wherein the pad is fabricated of a closed-cell polyethylene foam.

6. In a waterbed mattress structure:a flexible enclosing structure having horizontally extending top and bottom walls, a pad of buoyant material disposed within the enclosing structure and having a horizontal extent corresponding generally to the sleeping surface of the mattress, and means anchoring the pad to the bottom wall of the enclosing structure at a plurality of laterally spaced apart points whereby the pad is constrained to float above the bottom wall and below the top wall when the mattress is filled with water, the pad permitting water to circulate between the volume below and the volume above the pad.

7. In a waterbed mattress structure: a flexible enclosing structure having horizontally extending top and bottom walls, a pad of buoyant material disposed within the enclosing structure and having a horizontal extent corresponding generally to the sleeping surface of the mattress, and means anchoring the pad to the bottom wall of the enclosing structure at a plurality of laterally spaced apart points whereby the pad is constrained to float above the bottom wall and below the top wall when the mattress is filled with water, the means anchoring the pad comprising a flexible sheet overlying the pad and means connecting the sheet to the bottom wall through openings in the pad, the pad permitting water to circulate between the volume below and the volume above the pad.

8. The waterbed mattress of claim 7 wherein the means connecting the sheet to the bottom wall comprises a plurality of flexible straps affixed to the sheet and to the bottom wall,

9. The waterbed mattress of claim 7 wherein the means connecting the sheet to the bottom wall comprises a plurality of elongated tubular members affixed longitudinally to the bottom wall and connected to the sheet through the openings in the pad.

10. In a waterbed mattress having an enclosing structure comprising a horizontally extending top wall, a horizontally extending bottom wall, and side walls, the improvement comprising a horizontally extending pad disposed within the enclosing structure and spaced apart form the top wall and the bottom wall for limiting the motion of water in the mattress, the pad having a horizontal extent corresponding generally to the sleeping surface of the mattress, the pad permitting water to circulate between the volume below and the volume above the pad.

11. The mattress of claim 10 wherein the pad is positioned between the top wall and the bottom wall and is closer to the top wall than the bottom wall when the mattress is filled with water.

12. The mattress of claim 10 including means for anchoring the pad to the bottom wall of the enclosing structure.

* * * * *